United States Patent [19]

Lee et al.

[11] Patent Number: 4,508,808

[45] Date of Patent: Apr. 2, 1985

[54] METHOD OF USING DIAZOTYPE PHOTOGRAPHIC MATERIALS WITH PREEXPOSURE TREATMENT TO FORM UNIFORM SITES OF REFRACTIVE INDEX CHANGE

[75] Inventors: Wai-Hon Lee, Cupertino; Paul H. Voisin, San Mateo, both of Calif.

[73] Assignee: Xidex Corporation, Calif.

[21] Appl. No.: 440,890

[22] Filed: Nov. 12, 1982

[51] Int. Cl.[3] ..... G03C 5/18

[52] U.S. Cl. ..... 430/146; 430/141; 430/168; 430/169; 430/152; 430/176; 430/290; 430/327; 430/494

[58] Field of Search ..... 430/168, 169, 176, 152, 430/327, 290, 146, 494, 141

[56] References Cited

U.S. PATENT DOCUMENTS

| | | | |
|---|---|---|---|
| 2,501,874 | 3/1950 | Peterson | 95/8 |
| 2,908,572 | 10/1959 | Schoen et al. | 96/49 |
| 3,149,971 | 9/1964 | Baril et al. | 96/49 |
| 3,301,679 | 1/1967 | Halperin et al. | 96/75 |
| 3,408,192 | 10/1968 | Aebi | 430/152 |
| 3,493,371 | 2/1970 | Poot | 430/170 |
| 3,622,333 | 11/1971 | Cope | 96/75 |
| 3,841,874 | 10/1974 | Nishino | 96/27 |
| 4,152,156 | 5/1979 | Voisin | 430/152 |

OTHER PUBLICATIONS

Cope, O. J., "Diazo and Vesicular Microfilm Technologies," J. of Applied Photo. Eng., vol. 8, No. 5, pp. 190–199, 10/1982.

"The Diazotype Printing Process a Review," Dr. Louis van der Grinten, *The Photographic Journal,* vol. 92B (1952), pp. 43–48.

"Diazo Compounds in the Photocopying Industry," R. Landau, et al., *The Journal of Photographic Science,* vol. 13 (1965), pp. 144–151.

*Primary Examiner*—Charles L. Bowers, Jr.

*Attorney, Agent, or Firm*—Townsend and Townsend

[57] ABSTRACT

An improved diazotype photoprinting material of high printing speed and its method of preparation are disclosed. The improvement is achieved by distributing through the film coating a substantially uniform distribution of sites having a refractive index substantially different from that of the remainder of the coating. The sites consist of either voids or finely divided solids. Voids are created by contacting the film coating with an aqueous fluid at elevated temperature or an organic solvent for a sufficient period of time to cause a measurable haze to appear on the film. The sites operate to reflect or refract incident light rays during imagewise exposure, and thus increase the optical path length through a given thickness of film.

8 Claims, No Drawings

METHOD OF USING DIAZOTYPE PHOTOGRAPHIC MATERIALS WITH PREEXPOSURE TREATMENT TO FORM UNIFORM SITES OF REFRACTIVE INDEX CHANGE

BACKGROUND OF THE INVENTION

I. Field of the Invention

This invention relates to diazotype photographic materials. In particular, this invention relates to diazotype materials of increased photographic speed, and to a method for preparing such materials.

Diazo films and the imaging process associated therewith are well known in the art of photography and photoprinting materials. The imaging process is based upon the photodecomposition of diazonium salts when the latter are exposed to light, and the reaction between diazonium salts and appropriate couplers to produce azo dyes under alkaline conditions. According to the process, a light-sensitive layer containing a diazonium salt and a coupler is exposed to a lighted image, and the diazonium compound in the light-struck areas decomposes. When the entire layer is thereafter subjected to alkaline treatment, the residual diazonium salt in the areas not exposed to light couples with the azo coupling component to form an azo dye image of the original pattern. The film portions exposed to light thus have a low optical density, whereas a permanent dye color is formed in the remaining portions by the coupling reaction.

Diazotype films are generally composed of an inert base support with a thin coating of the active components in a vehicle or binding material. The latter is applied in the form of a liquid emulsion and then allowed to solidify prior to image-wise exposure.

Unfortunately, the rate of photodecomposition for diazonium compounds is poor compared to the response rate of other photographic processes, notably the silver halide emulsion process. Furthermore, no chemical amplification technique is currently available to promote the photolysis of the diazonium salts. Since the rate of photolysis is proportional to the concentration of undecomposed diazonium compound present in the film, the rate decreases sharply after the initial exposure of the film to light. The exposure time thus required to decompose the last remaining amounts of diazonium compound is relatively long. For this reason, diazotype materials have a low printing speed, requiring long exposures even with proper light sources.

The printing speed of a diazotype film is dependent on several factors, including the absorption coefficient of the diazonium compound with respect to the wavelength of the light to which the film is exposed, the length of the optical path through the diazotype film, and the concentration of the diazonium salt in the film. It is, accordingly, an object of the present invention to enhance the sensitivity of diazotype materials by increasing the optical path length through a film of given thickness.

Other objects will be apparent from the following description.

II. Description of the Prior Art

Diazotype films and methods of preparation thereof are generally disclosed in Peterson, U.S. Pat. No. 2,501,874 (Mar. 28, 1950), Halperin, et al., U.S. Pat. No. 3,301,679 (Jan. 31, 1967), van der Grinten, *The Photo-*

*graphic Journal*, 92B:43–48 (1952), and Landau, et al., *J. Photog. Sci.*, 13:144–151 (1965).

A similar problem of slow printing speeds exists in vesicular photographic materials. Various means for increasing the speed of such materials are disclosed in Schoen, et al., U.S. Pat. No. 2,908,572 (Oct. 13, 1959), Baril, et al., U.S. Pat. No. 3,149,971 (Sept. 22, 1964), and Nishino, U.S. Pat. No. 3,841,874 (Oct. 15, 1974). The chemistry of vesicular photography, however, is radically different from that of diazotype photography. In vesicular photography, a compound which undergoes photolysis to yield gaseous products is dispersed in a polymeric vehicle. Development of the image is accomplished by the application of heat, and image formation is accomplished by light scattering rather than light absorption. Both the chemistry and the physical interactions are entirely distinct from those of the diazotype process.

SUMMARY OF THE INVENTION

It has now been discovered that a diazotype photoprinting material of high printing speed is produced by introducing throughout the active component layer a substantially uniform distribution of sites having a refractive index substantially different from that of the remainder of the layer. The sites consist either of minute voids or gas bubbles suspended throughout the thickness of the layer, or finely divided solids or crystalline matter. The voids or solids are of minute dimensions compared to the thickness of the layer, and they serve to reflect and refract incident light and thus effectively increase the optical path length through the film.

The voids are created either by contacting the prepared films with an aqueous fluid at elevated temperature or an organic solvent for a sufficient period of time to cause a slight haze to appear on the film.

The solids suspension is created by dispersing the solids through the liquid coating composition prior to applying the latter to the base support. The difference in refractive index between the voids or solids on the one hand and the remainder of the active component layer on the other is any degree which is sufficient to cause the scattering of incident light rays and thereby increase the effective optical path length.

The novel films of the present invention offer a significant advantage in printing speed. The rate of light incidence on the remaining diazonium salts after the majority have been decomposed is considerably increased, and the exposure time necessary to obtain a properly exposed image is consequently decreased. The result is a photographic film of increased efficiency.

DESCRIPTION OF THE PREFERRED EMBODIMENTS

According to the present invention, light scattering sites throughout the film coating in a diazotype photoprinting material consist of either voids or finely divided solids. The voids are introduced into the coating by a physical degradation process applied to the coating after the latter is applied to the base support and dried. The solids are introduced into the coating composition while the latter is still in liquid form to convert the latter to a suspension, which is then applied to the base support and dried.

Voids are created in either of two ways. One is by contacting the coated support with a heated aqueous fluid. The other is similar to the first, but involves the use of an organic solvent in place of the aqueous fluid.

In the aqueous fluid embodiment, the term "fluid" is intended to include both liquids and gases, and the term "aqueous" is intended to denote any mixture or solution in which water is the major component. Among liquids, water alone and aqueous solutions of inorganic salts and/or wetting agents are examples. Among gases, steam alone and steam in combination with any gases which are inert with respect to the photographic film such as air, nitrogen, etc., are examples. Water and steam are preferred. Contact between the film and the fluid is readily accomplished by immersing the film in a liquid bath (when the fluid is in liquid form), or placing the film in a zone containing the water vapor (when the fluid is in gaseous form) as above a heated or boiling bath.

The temperature of the aqueous fluid and the contact time are not critical, but merely that sufficient to produce a slight haze in the photographic film. The degree of haze may vary widely. For most applications, a haze with an optical density ranging from about 0.01 to about 1.0 is appropriate, preferably from about 0.01 to about 0.40. The treatment conditions to achieve this with aqueous liquids will generally involve a temperature within the range of about 35° C. to about 120° C., preferably from about 50° C. to about 80° C.; and an exposure time of from about 5 seconds to about 300 seconds, preferably from about 10 seconds to about 60 seconds. When steam is used, it may be either saturated or superheated. Although the pressure and temperature may be widely varied, saturated steam at atmospheric pressure is preferred. The contact times cited above for aqueous liquids are similarly applicable to steam usage, although somewhat reduced contact times are generally sufficient. The degree of heat and the contact time in either case will depend upon the composition of the aqueous fluid or vaporous mixture used for treatment as well as the sensitivity of the materials in the photographic film. In general, shorter treatment times will suffice when higher temperatures are used.

In the organic solvent embodiment, certain organic solvents of various types depending on the composition of the photographic film are used in place of the aqueous fluid. The organic solvents generally fall within two structural categories—low molecular weight alcohols and acetonitrile, the latter being particularly well suited to films where the binding agent is a linear poly(hydroxy ether) of the type disclosed in Cope, U.S. Pat. No. 3,622,333 (Nov. 23, 1971).

The term "low molecular weight alcohols" is used herein to denote hydroxy hydrocarbons of up to about 6 carbon atoms. Preferred such compounds are saturated alkanols of straight- or branched-chain configuration, ranging from 1 to 3 carbon atoms. Examples are methyl alcohol, ethyl alcohol, propyl alcohol, and isopropyl alcohol. Methyl alcohol is preferred.

As in the case of the aqueous fluid treatment, the organic solvent may be in either liquid or gaseous form and the temperature and time of contact can vary over a wide range, provided that a haze is created in the film. For most applications, a temperature ranging from about 20° C. to about 60° C., preferably about 30° C. to about 40° C., and a contact time ranging from about 1 to about 100 seconds, preferably from about 10 to about 60 seconds, will be sufficient. As in the aqueous fluid treatment, the optimum temperature and contact time will depend on the composition of the photographic film, the particular organic solvent used, and the type and extent of photographic improvement sought. Increasing the temperature and/or contact time will generally enhance the effects of the treatment until the maximum possible improvement is reached. Otherwise, the limiting factor will be that point where the film is adversely affected by excessive heat and/or solvent attack.

Where even greater improvement is desired in the organic solvent embodiment, a second treatment can be administered by contacting the film with water following the initial contact with the organic fluid. Again, the temperature and time of contact are not critical and the optimum conditions will depend on the nature of the film and the nature and extent of the preceding organic fluid treatment. For most applications, the temperature within the range of about 20° C. to about 90° C. and contact times within the range of about 1 to about 100 seconds will provide the best results.

Following contact with the treating fluid,, be it aqueous or organic, an equilibration period is required before the film is ready for imaging exposure. Water or organic solvent that has been absorbed during the treatment is released during this period. This may be conveniently accomplished by storing the film so that its surface is in communication with the ambient atmosphere for a sufficient time to permit substantial release of moisture or solvent. If no such release is permitted prior to image-wise exposure, the effects of the treatment are generally not great, or the film may even be substantially photographically inoperative. Generally, release of as much moisture or solvent as possible is desired so as to approach zero liquid retention. Retention of less than about 1% is a practical goal.

The conditions of storage will govern the precise time at which sufficient equilibration has occurred so that the benefits of the treatment are fully obtained. Usually, sufficient moisture or solvent release may be obtained with as little as 5 or 10 minutes of equilibration with the ambient atmosphere. In most cases, best results are obtained with about 6–48 hours of equilibration. Even longer periods may be beneficial in some cases.

Finely divided solids distributed throughout the active component layer of the photographic film also form light scattering sites provided that the solids consist of materials with a refractive index substantially different from that of the remainder of the layer. Incorporation of the solid particles can be readily accomplished by mixing the particles in with the emulsion containing and imaging components prior to applying the emulsion to the base support. With proper and complete mixing, the emulsion upon solidifying will create a layer over the support with a uniform dispersion of particles throughout. The particles must therefore be insoluble in the emulsion as well as having a refractive index which differs substantially from that of the finished film. An example of a material from which such particles can be made is silver nitrate.

The particle size of the solids is not critical and can vary over a wide range. It is preferred, however, that the largest dimension of a typical particle be about half the wavelength of the light used for exposure. For most applications, particles of from about 0.1 micron to about 0.5 micron in size will provide the best results. The amount of particles can also vary widely. Generally, a quantity ranging from about 0.1% to about 10% by weight of the finished film will provide the best results.

Diazotype film materials suitable for treatment according to the present invention include all such materials known for use in diazotype imaging, and are prepared by standard methods described in the prior art (see Poot, U.S. Pat. No. 3,493,371, Feb. 3, 1970, and Halperin et al., supra). The films have a supporting base, normally a supporting sheet of any polymer film, plastic, Mylar™ (poly(ethylene terephthalate)), fabric, paper or the like, on which is coated a film layer, approximately 1 to 10 microns thick, of a light-sensitive azo coupling component, a stabilized light-decomposable diazonium compound, an acid or neutral substance capable of generating alkali upon heating, to stabilize the system and to prevent premature coupling between the diazonium compounds and the azo coupling component, and a film-forming binder. Other stabilizing additives, such as development accelerators, antioxidants and stabilizers for the diazonium compounds, may be employed optionally.

Preferred diazonium compounds are those having an aromatic moiety consisting of a substituted or unsubstituted benzene, naphthalene, anthracene or other fused ring system including heterocyclics. The substituents on the rings may be aromatic or aliphatic, oximino, amino, alkyl or oxyalkyl, preferably of from 1 to 4 carbon atoms. The diazonium compounds well known to those skilled in the art are suitable to be employed. These include, but are not limited to, those compounds listed in Peterson, Halperin, et al., and van der Grinten, supra, each of which is hereby incorporated herein by reference. Preferred compounds are N-mono and N-disubstituted p-aminobenzenediazonium salts because of their heat stability without loss of light sensitivity. These p-aminobenzenediazonium salts generally have the structure:

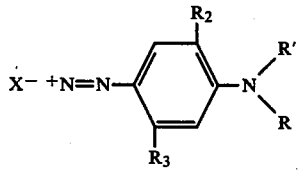

where R and R' are substituted or unsubstituted oximino, alkyl or alkenyl or oxyalkyl of from 1 to 4 carbon atoms or substituted or unsubstituted aryl or oxyaryl, or heterocyclic or hydrogen; X is a halide, substituted or unsubstituted borate, phosphate, nitrate, sulphate, or the like; $R_2$ and $R_3$ are alkyl, oximino, alkenyl or oxyalkyl of from 1 to 4 carbon atoms, aryl, oxyaryl, halide or hydrogen.

Examples of these p-aminobenzenediazonium salts include but are not limited to:

N-ethyl-N-beta hydroxy ethyl-p-aminobenzenediazonium chloride,
N,N-diethyl-p-aminobenzenediazonium stannic chloride,
N-benzyl-N-ethyl-p-aminobenzenediazonium phosphate,
N-ethyl-p-aminobenzenediazonium cupric chloride,
N,N-diethyl-2-ethoxy-4-aminobenzenediazonium fluoborate,
N-ethyl-2-methyl-4-aminobenzenediazonium cadmium chloride,
N,N-bis-hydroxyethyl-p-aminobenzenediazonium fluoborate,
N-beta-hydroxyethyl-N-methyl-p-aminobenzenediazonium zinc chloride,
p-diethylaminobenzenediazonium fluoborate,
3-methyl-b 4-pyrrolidinyl benzenediazonium fluoborate, p0 2,5-diethoxy-4-morpholino benzenediazonium fluoborate.

Coupling components are disclosed in Peterson, Halperin, et al., van der Grinten, and Landau, et al, supra. Preferred couplers are phenols, naphthols, and derivatives thereof, including dihydric and trihydric derivatives, as well as pyrazolones, phenylene diamines, and diprotic acids. Examples include but are not limited to:

2,3-dihydroxynaphthalene-6-sulfonic acid
2,7-dihydroxynaphthalene,
2,6-dihydroxynaphthalene,
resorcinol,
octyl resorcinol,
α-resorcylamide,
3-methyl-1-phenyl-5-pyrazolone,
2,5-xylenol,
4,4'-diresorcyl sulfide,
2-methyl resorcinol,
2,6-dihydroxy-3,7-naphthalene dicarboxylic anilide,
2-hydroxynaphthalene 3-carboxylic acid-2'- methoxy anilide.

Stabilizers for preventing premature coupling between the diazonium salt and the azo coupler are primarily acids and acid salts. Examples of such acids include but are not limited to citric acid, tartaric acid, carboxylic acids, sulfonic acids, and other organic and inorganic acids. The acid salts are monoalkali salts of strong organic acids which yield alkaline compounds upon heating. Examples include but are not limited to sodium, potassium, and nitrogen-based salts of oxalic, malonic, maleic, and substituted and unsubstituted acetic acids.

Film-forming binders known in the art for diazotype films are also useful in the present invention. Examples include, but are not limited to, polyvinyl alcohols, polyvinyl acetate, polyvinyl chloride, polyvinyl chloride-acetate, polyvinylidene chloride, polymethylmethacrylate, and water-soluble colloids such as gelatin, methyl and ethyl cellulose, and hydroxyethyl cellulose, and polyhydroxyether polymers of epihalohydrins and dihydric phenols such as those disclosed in Cope, U.S. Pat. No. 3,622,333 (Nov. 23, 1971), hereby incorporated herein by reference. For embodiments involving the use of aqueous fluid, only those binding materials with hydrophilic character are suitable. Examples of these are polyhydroxyethers and acrylonitrile copolymers.

Any aqueous solvent or non-aqueous organic solvent may be employed as a dispersing medium for the film components. The organic solvents employable include but are not limited to dimethyl formamide, substituted and unsubstituted ketones, substituted and unsubstituted alcohols and the like.

The following examples are offered by way of illustration and are not intended to limit the invention in any manner:

EXAMPLE 1

A coating solution was prepared in the following manner:

| | |
|---|---|
| condensation polymer of resorcinol, bis-(p-hydroxy-phenyl)sulfone and epichlorohydrin as described in Cope, U.S. Pat. No. 3,622,333, supra | 5.00 grams |
| 2,5-diethoxy-4-morpholino benzene diazonium fluoborate | 0.40 grams |

-continued

| | |
|---|---|
| 5-sulfosalicylic acid | 0.08 grams |
| 2-hydroxynaphthalene 3-carboxylic acid-2'-methoxy anilide | 0.40 grams |
| 2-methoxyethanol | 20 grams |

After dissolution, the resulting mixture was applied to a poly(ethylene terephthalate) support and dried to yield a 6 micron thick clear coating.

A portion of the coated support was then immersed in a water bath set at 60° C. for 20 seconds. The film was then allowed to equilibrate for 10 minutes at room temperature; whereupon a light haze appeared, measuring 0.10 diffuse density.

Samples of both the treated and untreated emulsion were exposed for 30 seconds through a step wedge Kodak No. 2 filter to a medium pressure mercury arc lamp (400 watts) at a distance of 6 inches. The samples were then allowed to stand at room temperature until the nitrogen gas produced by the photodecomposition of the diazonium salt had diffused out of the coating. Both samples were then developed with a diazo developer (Xidex XPD-24) set at 75° C. for 4 seconds. A blue image of the step wedge appeared on each sample, the treated sample showing one less step. The diffuse densities of the steps were measured. The results are listed in Table I where it is clear that the degree of photolysis is much greater for the treated sample; i.e., the optical density, an indication of the concentration of undecomposed diazonium compound, is lower.

TABLE I

| | Optical Density | |
|---|---|---|
| Step No. | Control | Treated Sample |
| 1 | .06 | .05 |
| 2 | .12 | .05 |
| 3 | .23 | .08 |
| 4 | .41 | .24 |
| 5 | .62 | .65 |
| 6 | .82 | .77 |
| 7 | 1.04 | .95 |
| 8 | 1.27 | 1.14 |
| 9 | 1.39 | 1.34 |
| 10 | 1.48 | 1.44 |

EXAMPLE 2

A diazotype film was prepared in the same manner as that described in Example 1, and a portion was treated as in Example 1. The treated and untreated portions were then exposed for a series of increasing exposure times to the light beam of a 36 mw argon ion laser emitting at 488 nm. The samples were then developed and the densities of the images were measured. The results are reported in Table II, which shows that 2 minutes' exposure time on the treated sample produced approximately the same result in terms of optical density as 4 minutes' exposure time on the untreated sample.

TABLE II

| | Optical Density | |
|---|---|---|
| Exposure Time (sec.) | Control | Treated Sample |
| 0 | 1.80 | 1.80 |
| 0.5 | 1.12 | .88 |
| 1 | .68 | .34 |
| 2 | .33 | .13 |
| 4 | .15 | .07 |
| 6 | .11 | .06 |

EXAMPLE 3

Two coating solutions were prepared as follows:

Solution A: A mixture was prepared by dissolving 4 g of cellulose acetate propionate polymer (Eastman Kodak) in 18 g of 2-methoxy ethanol and 18 g of methyl ethyl ketone. To this mixture was added 0.40 g of 2,5-diethoxy-4-morpholino benzene diazonium fluoborate, 0.08 g of 5-sulfosalicylic acid, and 0.40 g of 2-hydroxynaphthalene 3-carboxylic acid-2-methoxy anilide.

Solution B: A solution identical to Solution A was prepared, to which was further added 0.2 g of vinyl chloride-vinyl alcohol copolymer (18% alcohol, 82% chloride).

Coatings of Solutions A and B were prepared on a poly(ethylene terephthalate) support using a 3 ml gap doctor blade followed by drying in a 105° C. forced air oven for two minutes.

A sample of film of Solution A coating and one of Solution B were subjected to the steam of boiling water for 10 seconds; sample B showed after treatment a slight haze measuring 0.05 diffuse density while sample A showed no change.

Both films were exposed and developed in the manner described in Example 1, using the same step wedge.

The net densities (obtained after subtracting the background haze density) of the image of the steps were then measured and the results are listed in Table III.

TABLE III

| | Net Optical Density | |
|---|---|---|
| Step No. | Film A | Film B |
| 1 | 0.00 | 0.00 |
| 2 | 0.02 | 0.00 |
| 3 | 0.10 | 0.04 |
| 4 | 0.20 | 0.12 |
| 5 | 0.36 | 0.34 |
| 6 | 0.64 | 0.62 |
| 7 | 0.89 | 0.86 |
| 8 | 1.10 | 1.08 |

It is clear from Table III that the reduction in optical density shown for Step 3 using the nonhydrophilic binder (Film A) is comparable to that shown for Step 4 of the hydrophilic binder (Film B). The step wedge had an increment density of 0.10. Since the density is a logarithmic function of transmitted light, the attenuation of light from one step to the next was 20%, and the speed increase was thus also about 20%.

The foregoing description is offered solely for purposes of illustration; the invention is not intended to be limited to the particular features of construction and operation described herein. Numerous modifications and variations of the above still falling within the spirit and scope of the invention as claimed hereinbelow will be readily apparent to those skilled in the art.

What is claimed is:

1. A method for preparing a diazotype photoprinting material having an azo dye image thereon, said method comprising:

(a) providing a photoprinting material comprising a base support coated with a dry substantially uniform layer of a composition comprising a light-decomposable diazonium salt, an azo coupler, an acid or alkali-generating neutral stabilizer, and a film-forming binder, said layer further containing a plurality of sites distributed therethrough in substantially uniform manner, said sites having a refractive index substantially different from that of the remainder of said layer;

(b) exposing said photoprinting material in imagewise manner;

(c) permitting substantially all nitrogen gas produced during step (b) to diffuse out of said composition; and (d) developing said exposed photoprinting material to produce an azo dye image.

2. A method according to claim 1 in which said sites are either voids or finely divided solids.

3. A method according to claim 1 in which said distribution is achieved by contacting said layer with an aqueous fluid at an elevated temperature, or a low molecular weight alcohol or acetonitrile, followed by equilibrating said layer in ambient atmosphere to permit substantial release of liquid; or by dispersing through said coating composition an effective amount of finely divided solids.

4. A method according to claim 1 in which said film-forming binder is of hydrophilic character, and said distribution is achieved by contacting said layer with a aqueous fluid at an elevated temperature followed by equilibrating said layer in ambient atmosphere to permit substantial release of liquid, to produce a haze of optical density of from about 0.01 to about 1.0 in said layer.

5. A method according to claim 1 in which said film-forming binder is a polyhydroxyether polymer of an epihalohydrin and a dihydric phenol or a copolymer of vinyl chloride and vinyl alcohol, and said distribution is achieved by contacting said layer with an aqueous fluid at a temperature of from about 35° C. to about 120° C. for a time ranging from about 5 seconds to about 300 seconds, followed by equilibrating said layer in ambient atmosphere to permit substantial release of moisture, to produce a haze of optical density of from about 0.01 to about 1.0 in said layer.

6. A method according to claim 1 in which said film-forming binder is a polyhydroxyether polymer of an epihalohydrin and a dihydric phenol or a copolymer of vinyl chloride and vinyl alcohol, and said distribution is achieved by contacting said layer with an aqueous fluid at a temperature of from about 50° C. to about 80° C. for a time ranging from about 10 seconds to about 60 seconds, followed by equilibrating said layer in ambient atmosphere to permit substantial release of moisture, to produce a haze of optical density of from about 0.01 to about 0.40 of said layer.

7. A method according to claim 6 in which said film-forming binder is a condensation polymer of resorcinol, bis-(p-hydroxyphenyl)sulfone and epichlorohydrin and said aqueous fluid is heated water or saturated steam.

8. A method according to claim 6 in which said film-forming binder is a copolymer of vinyl chloride and vinyl acetate and said aqueous fluid is saturated steam.

* * * * *